United States Patent [19]

Dorsey, Jr.

[11] 4,099,989

[45] Jul. 11, 1978

[54] PROTECTIVE COATING FOR ALUMINUM PRODUCTS

[75] Inventor: Geoffrey A. Dorsey, Jr., Danville, Calif.

[73] Assignee: Kaiser Aluminum & Chemical Corporation, Oakland, Calif.

[21] Appl. No.: 709,027

[22] Filed: Jul. 27, 1976

Related U.S. Application Data

[63] Continuation-in-part of Ser. No. 610,966, Sep. 8, 1975, Pat. No. 4,004,951, which is a continuation-in-part of Ser. No. 593,092, Jul. 3, 1975, abandoned.

[51] Int. Cl.[2] ..... C23F 7/00

[52] U.S. Cl. ..... 148/6.27; 427/292; 427/327; 72/46; 72/42; 252/32

[58] Field of Search ..... 148/6.27; 427/327, 292; 72/46, 42; 252/18, 17, 32

[56] References Cited

U.S. PATENT DOCUMENTS

| | | | |
|---|---|---|---|
| 2,413,220 | 12/1946 | Elder et al. | 72/42 X |
| 2,963,391 | 12/1960 | Kubie | 148/6.14 |
| 3,098,294 | 7/1963 | Schapiro | 72/42 X |
| 3,105,400 | 10/1963 | Goppelt | 72/46 |
| 3,836,467 | 9/1974 | Jones | 252/18 |
| 3,923,671 | 12/1975 | Knepp | 72/42 X |

*Primary Examiner*—Ralph S. Kendall
*Attorney, Agent, or Firm*—Paul E. Calrow; Edward J. Lynch

[57] ABSTRACT

This invention relates to the formation of a hydrophobic and usually oleophilic coating on an aluminum surface by mechanically deforming or upsetting the aluminum surface to disrupt the natural oxide coating in the presence of alkaline agents and a long chain aliphatic carboxylic acid or other equivalent long chain aliphatic carboxylate compounds. Preferably, the carboxylic acid and alkaline agent are incorporated into a metal-working lubricant which is maintained on the aluminum surface during fabrication, such as rolling, so that the hydrophobic coating is formed simultaneously with fabrication and thereby avoid the necessity of a separate coating operation.

11 Claims, No Drawings

PROTECTIVE COATING FOR ALUMINUM PRODUCTS

RELATED APPLICATIONS

The application is a continuation-in-part of application Ser. No. 610,966 filed Sept. 8, 1975 now U.S. Pat. No. 4,004,951, which, in turn, is a continuation-in-part of application Ser. No. 593,092 filed July 3, 1975, now abandoned.

BACKGROUND OF THE INVENTION

This invention is directed to a simple method of forming a protective, hydrophobic coating on an aluminum surface.

Many processes are presently available for forming protective coatings on aluminum surfaces, such as anodizing, plating, chemical conversion coating, painting and the like. The coatings resulting from these processes, although designed for long life, require extensive surface pretreatments and are quite expensive. However, frequently, only short-term protection is needed, e.g., to prevent water stain in the shipping or storing of semifabricated aluminum products, such as coiled sheet and the like. In some instances, such as in welding or adhesive bonding aluminum products, it is desirable to prevent the gradual buildup of thick natural oxide on the aluminum surface, because a thick natural oxide coating can interfere with these processes. However, no simple and inexpensive process is presently known which will give short-term protection to aluminum products without interfering with subsequent fabrication, particularly when lubricants must be applied to the surface, or without detrimentally affecting the surface appearance of the fabricated product.

A simple, inexpensive process for coating aluminum is described by Wittrock et al in U.S. Pat. No. 3,726,721, assigned to the present assignee, but the friable coating formed by this process can have detrimental effects on the surface of the metal during subsequent forming or coating operations.

Kubie in U.S. Pat. No. 2,963,391 describes a process for forming a coating designed as an extrusion lubricant wherein the aluminum surface is first treated with an ammonia-laden alkaline solution containing a fatty acid (or equivalent salt or ester thereof) and then baked at about 400° F to form a coating having unknown properties except for lubrication.

Marosi in U.S. Pat. No. 3,849,207 describes and claims a process for treating aluminum and other metals wherein the surface is treated with an alkaline sodium formate solution and then coated with a clear resinous film to form a sepia-colored coating. The nature of the coating formed during treatment in the alkaline sodium formate solution is not described in the reference. However, it has been found that the aluminum surface underlying such a coating is susceptible to water stain or other oxidation in much the same manner as untreated aluminum because the coating is readily wet and penetrated by water or aqueous solutions.

It is against this background that the present invention was developed.

DESCRIPTION OF THE INVENTION

The invention is directed to the formation of a protective coating on an aluminum surface and particularly to the formation of a tenacious hydrophobic coating which protects the underlying aluminum surface from oxidation. As used herein, aluminum refers to pure aluminum, commercially pure aluminum and aluminum alloys. Numbered aluminum alloy identifications herein refer to Aluminum Association alloy designations.

In accordance with the invention, an aluminum surface is mechanically deformed or upset under aqueous alkaline conditions in the presence of a long chain aliphatic carboxylic acid, an equivalent alkali metal salt thereof or a compound which generates a reactive long chain aliphatic carboxylate anion during the deformation of the aluminum surface. The surface coating which forms under these conditions is hydrophobic and usually high oleophilic. Moreover, the coating is not significantly affected by short-term exposure to mineral acids, such as nitric acid, hydrochloric acid or sulfuric acid at room temperatures or by common polar solvents, such as acetone or ethyl alcohol. The coating formed is very difficult to analyze because under most circumstances, it appears to be a monomolecular layer on the order of 100 A thick.

When the aluminum surface is deformed or otherwise upset, the aged, natural oxide coating on the surface is apparently broken up, thereby exposing a nacent aluminum surface which immediately oxidizes. The newly formed oxide is more reactive than the aged natural oxide and the aluminum surface having a newly formed oxide coating is herein referred to as a "fresh" aluminum surface. Under the aqueous alkaline conditions of the invention, the carboxylic acid or the equivalent carboxylate compound apparently either reacts with the fresh aluminum surface to form a type of aluminum soap or at least strongly associates with the fresh aluminum surface. The carboxylic acid can be most readily applied to the exposed fresh surface by incorporating the acid or its equivalent into the metal-working lubricant. This allows the coating to be formed while the aluminum workpiece is being shaped or reduced in cross section, thereby eliminating an additional processing step. Oil-based lubricants or oil-in-water emulsified lubricants can be employed.

An alkaline material, such as sodium or potassium hydroxide, is mixed with the carboxylic acid carrier to generate the alkaline conditions necessary for coating formation. In nonaqueous lubricant systems, the alkaline compound can be taken into the system by using a solvent which readily dissolves in or which is miscible with the nonaqueous lubricant carrier. Suitable solvents for the alkaline compounds in nonaqueous systems include ethyl alcohol, methyl ethyl ketone, acetone and other common organic polar solvents. The desired alkalinity level in nonaqueous systems can be determined by physically mixing 1 ml of the prepared lubricant with 10 ml of distilled or deionized water and determining the pH of the aqueous phase of the mixture. A pH of about 7.5–10 generally indicates that the desired alkalinity is present. In oil-in-water emulsions, the alkaline material is readily dissolved in the aqueous phase and the pH of the aqueous phase should also be from 7.5–10, preferably 8.0–9.5. Without the addition of the alkaline material, the fatty acids or their equivalent may at best physically coat the aluminum surface and can be readily removed by polar solvents, indicating that the desired tenacious coating has not been formed.

It appears that even with nonaqueous liquid systems, there is a sufficient amount of moisture at the metal-liquid interface during deformation or abrasion to develop the necessary alkaline conditions for coating formation. Moreover, there is sufficient heat generated at the interface by the surface deformation to assure coating formation within a reasonable time.

The carboxylic acids (or their equivalents) of the invention are excellent lubricity agents and can be readily incorporated into the lubricants, including oil-based and water-based lubricants. Most oil-based lubricant systems include a paraffinic or naphthenic hydrocarbon-base oil intermixed with one or more lubricity agents. Oil-in-water emulsion lubricant systems usually have an oil phase comprising a paraffinic or naphthenic hydrocarbon base oil, at least one lubricity agent and one or more emulsifiers and an aqueous phase consisting essentially of water. The carboxylic acid or other compound capable of generating a carboxylate anion of the invention can be used to replace in whole or part the lubricity agents in existing commercial lubricants. For example, a mixture of butyl stearate and commercial-grade lauryl alcohol in a hydrocarbon base oil has been used as a lubricant for the cold rolling of aluminum sheet. The carboxylic acid of the invention can replace in whole or part the butyl stearate, with the appropriate addition of an alkaline compound to the lubricant system by means of a miscible solvent as previously described.

The method of forming the coating during the deformation of the surface is particularly attractive for the cold rolling of continuous lengths of aluminum sheet. The resultant coated sheet product can be coiled in a conventional fashion upon exiting from the last stand of the cold rolling mill. There is no need to uncoil the coiled product for subsequent treatments, except for possibly leveling, slitting or edge trimming, if necessary. The coil can be packaged in a conventional manner and shipped or stored as-is with essentially no detrimental surface effects such as water stain occurring on the surface of the coiled metal.

Whether water- or oil-based carriers are used, the long chain aliphatic carboxylate compound need only be present in very small quantities, but usually more than one part per million (by weight) is needed. An operational level can range from about 0.01 to 10 grams/liter for aqueous systems and about 1 to 200 grams/liter for nonaqueous systems. It is preferred to maintain the carboxylate compound in a slight excess of saturation in the aqueous phase of oil-in-water emulsions for the convenience of composition control. The carboxylate compound can be a long chain aliphatic carboxylic acid (a fatty acid), an alkali metal salt, or other equivalent long chain aliphatic compound which generates a carboxylate anion in the alkaline conditions of the invention. The long chain carboxylic acid or its equivalent should have from 12–22 carbon atoms, preferably 14–20, in the aliphatic chain. Below 12 carbon atoms, the coatings are not sufficiently hydrophobic to be of any value in preventing the wetting of the coating and the penetration thereof by water or other aqueous solutions which can lead to water stain. Compounds with more than 22 carbon atoms in the aliphatic chain usually fail to react with the fresh aluminum surface and do not become strongly associated with the aluminum substrate. This latter feature is readily shown by removing the unreacted residue with polar solvents, such as acetone or ethyl alcohol. Suitable long chain aliphatic carboxylic acids include lauric acid, myristic acid, palmitic acid, stearic acid, oleic acid, ricinoleic acid, linoleic acid, arachidic acid and the like. Preferably, alkali metal salts of the above acids are used or are generated in solution. The sodium and potassium salts of the acids are the most desirable in the present invention; however, lithium and cesium are functional. Generally, esters of the carboxylic acids will not form the desired coatings unless they have been highly ethoxylated or otherwise contain substituents to render them more soluble in water. Crude grades of fatty acid esters may form the desired coating, but this is due to a high free fatty acid impurity level.

The aliphatic portion of the carboxylic acid or equivalent can be saturated or unsaturated; however, unsaturated compounds tend to be less effective than saturated compounds in forming the hydrophobic coating. Substitutions on the aliphatic chain can be made, provided they do not prevent the carboxylate compound from forming the desired coating. Particularly effective carboxylic acids are those described in co-pending application Ser. No. 709,026 which have at least one short secondary alkyl group on or near the nonpolar end of the carboxylic acid, such as isostearic acid.

If an oil-in-water emulsion is used as a carrier fluid for the carboxylate compound, wetting agents, such as Emsorb® 6903 (sold by Emery Industries, Inc.), Tween® 85 (sold by ICI American, Inc.) and Ultrawet® (sold by Armour and Company) can be added in amounts up to 3% by weight to facilitate the wetting of the aluminum surface by the alkaline solution during treatment. Other components, such as emulsifiers and the like, can also be added in amounts up to 3% by weight to render the fatty acid component emulsifiable with the aqueous solution. Mechanical dispersions can also be employed, for example, when it is difficult to emulsify the carboxylic acid in an aqueous alkaline solution.

Treatment conditions may be rendered alkaline by the addition of appropriate saponifying agents, such as an alkali metal hydroxide or ammonium hydroxide to the carrier fluid. However, in many instances, such as when utilizing some commercial grades of sodium stearate or sodium palmitate in an aqueous solution, the conditions will be sufficiently alkaline so that additional hydroxide additions become unnecessary. Although ammonium salts or ammonium hydroxide can be employed in the alkaline treatment solution, these compounds are not particularly desirable because ammonia tends to be driven from the solution during rolling or other deformation making composition control extremely difficult.

The surface coating which forms in the invention is neither readily wet nor penetrated by water or other nonalkaline aqueous solutions. The surface is usually oleophilic and is generally compatible with most metal-working lubricants including water-based emulsions. The compatibility of the coating with metal-working lubricants can be further enhanced by dipping the treated hydrophobic surface in an ambient temperature solution of a wetting agent at near neutral pH. Nonionic and cationic wetting agents are preferred. This latter treatment step to enhance wettability is unnecessary if isomeric forms of the caroboxylic acid (e.g., isostearic acid) are used as described in co-pending application Ser. No. 709,026.

The hydrophobic coating has an electrical resistance initially of about 10 microhms which remains relatively stable for at least 7 weeks. This indicates that essentially no oxidation of the underlying aluminum surface is occurring. These resistance levels are to be compared with a natural oxide coating which has an initial resistance of about 10 microhms and which can gradually increase to well over 1000 microhms in a matter of days. The relatively stable resistance exhibited by the coating of the invention is a very advantageous feature. For example, in the spot resistance welding of aluminum, neither very high nor very low surface electrical resistance is desired. Preferably, the resistance should range from about 40–100 microhms. The preferred resistance can be developed by first forming an oxide coating of controlled thickness and/or electrical resistance and then forming the hydrophobic surface of the invention on the freshly prepared oxide layer. The hydrophobic surface layer effectively prevents the further oxidation of the underlying aluminum substrate so that the oxide thickness and/or resistance is stabilized within the preferred range over extended periods.

The hydrophobic aluminum surfaces of the invention have many other unique and attractive features. For example, when such surfaces are subjected to elevated temperatures in an anodizing atmosphere, the hydrophobic coating is itself destroyed but a very thin and dense oxide coating is formed which prevents further oxidation. Thus, during annealing or other high temperature thermal treatments, the aluminum surface remains free of discoloration and surface disfigurement. Similar effects are noted with commercial vacuum brazing sheet having a hydrophobic coating in accordance with the invention. After vacuum brazing with such treated sheet, the brazements are not discolored or otherwise disfigured due to the vacuum brazing process.

The coating of the invention can be readily removed by treatment with hot cleaning solutions (acid or alkaline) normally employed to clean aluminum surfaces prior to various surface treatments, such as anodizing, painting and the like.

Although cold rolling is described herein as the primary mode of surface deformation, forging, extruding and the like can be used. Moreover, surface abrading in any suitable manner has been found adequate to remove the oxide coating and expose a fresh aluminum surface.

The following examples are given to further illustrate the invention.

EXAMPLE I

A 3004 aluminum alloy sheet was cold rolled on a small laboratory rolling mill with an alkaline, oil-based lubricant consisting of 4% by weight isostearic acid (Emersol 817), 3% by weight of a mixture of C14, C16 and C18 alcohols (Alfol 1418) and the remainder a base hydrocarbon oil (Somentor 43). About 0.02 gram/liter of KOH was included with the alcohol mixture so that the lubricant exhibited a pH of 9.3 when mixed 1:10 with distilled water. The coating formed during rolling was hydrophobic, oleophilic and highly resistant to polar organic solvents.

EXAMPLE II

A 3004 aluminum alloy sheet was cold rolled on a small laboratory rolling mill with an alkaline oil-based lubricant consisting of 4% by weight stearic acid, 3% by weight of a mixture of C14, C16 and C18 alcohols (Alfol 1418) and the remainder a base hydrocarbon oil (Somentor 43). About 0.2 gram/liter of KOH was included with the alcohol mixture so that the lubricant exhibited a pH of 9.3 when mixed 1:10 with distilled water. The coating formed during rolling was hydrophobic and oleophilic, although less oleophilic than the coating formed in Example I.

EXAMPLE III

A solution of stearic acid and a small quantity ethyl alcohol saturated with KOH was prepared with the pH of the solution when mixed 1:10 with distilled water at 9.0. This solution was placed at the interface between two 3004 aluminum alloy sheet specimens and then the specimens were briskly rubbed together by hand for a few moments to mechanically abrade the oxide surfaces at the interface. After removing the residual solution, the abraded surfaces of the specimens exhibited the hydrophobic and oleophilic surface of the invention, although the surface was less oleophilic than those of Examples I and II.

What is claimed is:

1. A method of forming a tenacious, hydrophobic coating on an aluminum surface which is resistant to polar organic solvents consisting essentially of:

(a) mechanically disrupting the natural oxide coating on the aluminum surface to generate a fresh aluminum surface, and (b) maintaining on the aluminum surface during said disruption an alkaline liquid selected from the group consisting of nonaqueous liquids and aqueous liquids having a pH of less than 10, said liquid having dissolved therein an effective amount of an aliphatic carboxylic acid or an equivalent carboxylate compound having from 12–22 carbon atoms so that upon generation of a fresh aluminum surface by said disruption a tenacious hydrophobic coating is formed.

2. The method of claim 1 wherein the natural oxide coating is disrupted by rolling.

3. The method of claim 1 wherein the natural oxide coating is disrupted by forging.

4. The method of claim 1 wherein the natural oxide coating is disrupted by abrading the surface.

5. The method of claim 1 wherein the carboxylic acid or an equivalent carboxylate compound is incorporated into a lubricant which is applied to the aluminum surface prior to the deformation thereof to disrupt the natural oxide coating.

6. The method of claim 5 wherein the lubricant is an oil-based lubricant containing a base hydrocarbon oil and at least one lubricity agent.

7. The method of claim 6 wherein an alkaline compound selected from the group consisting of sodium hydroxide and potassium hydroxide is incorporated into the lubricant by dissolving the alkaline compound in a liquid which is soluble in the lubricant and then adding the thus-formed solution to the lubricant.

8. The method of claim 5 wherein the lubricant is an oil-in-water emulsion and wherein the oil phase of the emulsion contains at least one lubricity agent and a hydrocarbon base oil.

9. The method of claim 8 wherein the aqueous phase of the emulsion has a pH between 7.5 and 10.

10. The method of claim 9 wherein the pH of the aqueous phase is developed and maintained by additions of an alkaline compound selected from the group consisting of sodium hydroxide and potassium hydroxide.

11. The method of claim 1 wherein the carboxylic acid is selected from the group consisting of stearic acid and isostearic acid.

* * * * *